United States Patent [19]

Nguyen et al.

[11] Patent Number: 4,960,494

[45] Date of Patent: Oct. 2, 1990

[54] CERAMIC/METAL COMPOSITE MATERIAL

[75] Inventors: Thinn Nguyen, Onex; Abdelkrim Lazouni, Geneva; Kim S. Doan, Onex, all of Switzerland

[73] Assignee: MOLTECH Invent S.A., Luxembourg

[21] Appl. No.: 350,480

[22] PCT Filed: Aug. 30, 1988

[86] PCT No.: PCT/EP88/00785

§ 371 Date: Apr. 28, 1989

§ 102(e) Date: Apr. 28, 1989

[87] PCT Pub. No.: WO89/01991

PCT Pub. Date: Mar. 9, 1989

[30] Foreign Application Priority Data

Sep. 2, 1987 [AT] Austria ..... 810503/87

[51] Int. Cl.[5] ..... C25C 3/06; C25C 7/02

[52] U.S. Cl. ..... 204/67; 204/290 R; 204/290 F; 204/291; 204/292; 204/293; 427/77; 427/123; 427/126.3; 427/126.6; 427/341; 428/469; 428/471

[58] Field of Search ..... 204/67, 243 R, 290 R, 204/290 F, 291, 292, 293; 427/77, 123, 126, 126.2, 126.6, 341, 337; 428/469, 471

[56] References Cited

U.S. PATENT DOCUMENTS

| | | | |
|---|---|---|---|
| 3,804,740 | 4/1974 | Welch | 204/290 R |
| 4,173,518 | 11/1979 | Yamada et al. | 204/290 F |
| 4,243,497 | 1/1981 | Nicolas et al. | 204/290 R |
| 4,374,050 | 2/1983 | Ray | 252/519 |
| 4,374,761 | 2/1983 | Ray | 252/519 |
| 4,399,008 | 8/1983 | Ray | 204/67 |
| 4,478,693 | 10/1984 | Ray | 204/64 |
| 4,484,997 | 11/1984 | Secrist et al. | 204/290 R |
| 4,620,905 | 11/1986 | Tarcy et al. | 204/64 |

FOREIGN PATENT DOCUMENTS

| | | |
|---|---|---|
| 0114085 | 7/1984 | European Pat. Off. . |
| WO8102027 | 7/1981 | PCT Int'l Appl. . |
| 2088902 | 6/1982 | United Kingdom . |

*Primary Examiner*—John F. Niebling
*Assistant Examiner*—Kathryn Gorgos
*Attorney, Agent, or Firm*—John J. Freer

[57] ABSTRACT

A ceramic/metal composite material comprises a surface ceramic coating comprising an oxidized alloy of copper stabilized by being in solid solution with nickel oxide or manganese oxide on a substrate which is an oxidation resistant alloy essentially devoid of copper or any metal which oxidizes more readily than copper. The composite is made by oxidizing a copper-based alloy on a substrate and simultaneously oxidizing the substrate surface to form an oxygen-barrier interface, for example a chromium oxide layer formed on an alloy of chrominum with nickel, iron and/or cobalt. The composite may be used as anode substrate for a cerium oxyfluoride coating used in aluminum electrowinning.

13 Claims, No Drawings

CERAMIC/METAL COMPOSITE MATERIAL

FIELD OF INVENTION

A ceramic/metal comPosite material, particularly for high temperature applications such as aluminum electrowinning, is disclosed. The composite material comprises a metal substrate or core with a surface ceramic coating made from an at least partially oxidized alloy of copper and at least one other oxidizable metal. The oxide of the oxidizable metal stabilizes copper oxide.

BACKGROUND OF INVENTION

Materials used for high temperature applications must have a good stability in an oxidizing atmosphere, and good mechanical properties. In addition, materials used for electrodes in electrochemical processes in molten electrolytes must further have good electrical conductivity and be able to operate for prolonged periods of time under polarizing conditions. At the same time, materials used on an industrial scale should be such that their welding and machining do not present unsurmountable problems to the practitioner. It is well known that ceramic materials have good chemical corrosion properties. However, their low electrical conductivity and difficulties of making mechanical and electrical contact as well as difficulties in shaping and machining these materials seriously limit their use.

In an attempt to resolve well known difficulties with conductivity and machining of ceramic materials, the use of cermets was proposed. Cermets may be obtained by pressing and sintering mixtures of ceramic powders with metal powders. Cermets with good stability, good electrical conductivity and good mechanical properties, however, are difficult to make and their production on an industrial scale is problematic. Also, the chemical incompatibilities of ceramics with metals at high temperatures still present problems. Composite materials consisting of a metallic core inserted into a premachined ceramic structure, or a metallic structure coated with a ceramic layer have also been proposed.

U.S. Pat. No. 4,374,050 discloses inert electrodes for aluminum production fabricated from at least two metals or metal compounds to provide a combination metal compound. For example, an alloy of two or more metals can be surface oxidized to form a compounded oxide of the metals at the surface on an unoxidized alloy substrate. U.S. Pat. 4,374,761 discloses similar compositions further comprising a dispersed metal powder in an attempt to improve conductivity. U.S. Pat. Nos. 4,399,008 and 4,478,693 provide various combinations of metal oxide compositions which may be applied as a preformed oxide composition on a metal substrate by cladding or plasma spraying. The direct application of oxides by these application techniques, however, is known to involve difficulties. Finally, U.S. Pat. No. 4,620,905 describes an oxidized alloy electrode based on tin or copper with nickel, iron, silver, zinc, mangnesium, aluminum or yttrium, either as a cermet or partially oxidized at its surface. Such partially oxidized alloys suffer serious disadvatages in that the oxide layers formed are far too porous to oxygen, and not sufficently stable in corrosive environments. In addition, it has been observed that at high temperatures the partially oxidized structures continue to oxidize, and this uncontrolled oxidation causes subsequent segregation of the metal and/or oxide layer. In addition, the machining of ceramics and achieving a good mechanical and electrical contact with such materials involves problems which are difficult to solve. Adherence at the ceramic-metal interfaces is particularly difficult to achieve and this very problem has hampered use of such simple composites.

DISCLOSURE OF THE INVENTION

It is an object of the present invention to provide a ceramic/metal composite material comprising a metal substrate with a surface ceramic coating which is an at least partially oxidized alloy of copper and at least one other oxidizable metal, the oxide of which stabilizes copper oxide, in which the metal substrate is a relatively oxidation resistant metal or alloy essentially devoid of copper or any metal which oxidizes more readily than copper. Another object of the invention is to provide an improved anode for electrowinning aluminum and other metals from molten salts containing compounds (e.g. oxides) of the metals to be won, made from the ceramic/metal composite comprising a metal substrate with a surface ceramic coating which is an at least partially oxidized alloy of copper and at least one other oxidizable metal.

It is a further object of the invention to provide an improved electrochemical cell for electrowinning aluminum and other metals from their oxides with one or more anodes made from the ceramic/metal composite comprising a metal substrate with a surface ceramic coating which is an at least partially oxidized alloy of copper and at least one other oxidizable metal.

Still another object of the invention is to provide a method of manufacturing ceramic/metal composite structures having a good chemical stability at high temperatures in oxidizing and/or corrosive environments; a good electrochemical stability at high temperatures under anodic polarization conditions; a low electrical resistance; a good chemical compatibility and adherence between the ceramic and metal parts; a good mechinability; a low cost of materials and manufacture; and a facility of scaling up to industrial sizes.

Further objects and advantages of the invention are set out in the following description and in the appended claims. According to the invention the method of making the composite material comprises applying a copper-based alloy to the substrate alloy, and oxidizing the material to: (*a*) fully oxidize the copper to copper oxide, (*b*) at least partially oxidize other metal in the surface coating to stabilize the copper oxide, and (*c*) surface oxidize the substrate to form an oxygen-barrier interface oxide layer inhibiting further oxidation of the substrate.

The composite structure of the invention typically has a metallic core made of a high temperature resistant nickel, cobalt or iron based alloy and a metallic coating or envelope made of copper alloy. In addition to 55–90% by weight of the basic component nickel, cobalt and/or iron, the core alloy generally contains 10% to 30%, preferably 15% to 30% by weight of chromium, but is essentially devoid of copper or comparable metals which oxidize easily, i.e. contains no more than 1% by weight of such components, usually 0.5% or less. Other minor components such as aluminum, hafnium, molybdenum, niobium, silicon, tantalum, titanium, tungsten, vanadium, yttrium and zirconium can be added into the core alloy up to a total content of 15% by weight in order to improve its oxidation resistance at high temperatures. Other elements, such as carbon and boron, may also be present in trace quantities, usually well less than 0.5. Commercially available so-called superalloys or refractory alloys such INCONEL™ HASTALLOY™, HAYNES™, UDIMET™, NIMONIC™, INCOLOY™, as well as many variants thereof may conveniently be used for the core.

In preferred embodiments, the surface ceramic coating comprises an oxidized alloy of 15% to 75% by weight copper, 25% to 85% by weight of nickel and/or manganese, up to 5% by weight of lithium, calcium, aluminum, magnesium or iron and up to 30% by weight of platinum gold, and/or palladium in which the copper is fully oxidized and at least part of the nickel and/or manganese is oxidized in solid solution with the copper oxide, and the substrate comprises 15–30% by weight of chromium, 55–85% of nickel, cobalt and/or iron (for example 70% to 80% of nickel with 6–10% iron, or 75–85% iron) and up to 15% by weight of aluminum, hafnium, molybdenum, niobium, silicon, tantalum, titanium, tungsten, vanadium, yttrium and zirconium, the interface of the substrate with the surface ceramic coating having an oxygen-barrier layer comprising chromium oxide.

The metallic coating or envelope is made of a copper based alloy and is typically 0.1 to 2 mm thick. The copper alloy typically contains 20% to 60% by weight of copper and 40–80% by weight of another component of which at least 15–20% forms a solid solution Cu–Ni or Cu–Mn alloys are typical examples of this class of alloys. Some commercial Cu–Ni alloys such as varieties of MONEL™ or CONSTANTAN™ may be used.

The alloy core resists oxidation in oxidizing conditions at temperatures up to 1100°C. by the formation of an oxygen impermeable refractory oxide layer at the interface. This oxygen-impermeable electronically conductive layer is advantageously obtained by in-situ oxidation of chromium contained in the substrate alloy forming a thin film of chromium oxide, or a mixed oxide of chromium and other minor components of the alloys.

Alternatively, a chromium oxide barrier layer could be applied e.g. by plasma spraying on to a nickel, cobalt or iron-based alloy base, or other types of essentially oxygen-impermeable electronically-conductive barrier layers could be provided, such as a platinum/zirconium layer or a nickel-aluminum layer, mixed-oxide layers especially based on chromium oxide, alloys and intermetallics especially those containing platinum or another precious metal, or non-oxide ceramics such as carbides preferably, however, barrier layers containing chromium oxide, alone or with another oxide, will be formed by in-situ oxidation of a suitable alloy substrate but especially for other compositions, different methods are also available including torch spraying/plasma spraying, cathodic sputtering, electron beam evaporation and electroplating followed, as appropriate, by an oxidizing treatment before or the coating is applies as a metal, layer of different metals or as an alloy.

The metallic composite structure may be of any suitable geometry and form. Shapes of the structure may be produced by machining, extrusion, cladding or welding. For the welding process, the supplied metal must have the same composition as the core or of the envelope alloys. In another method of fabricating the metallic composite structures, the envelope alloy is deposited as a coating onto a machined alloy core. Such coatings may be applied by well-known deposition techniques: torch spraying, plasma spraying, cathodic sputtering, electron beam evaporation or electroplating. The envelope alloy coating may be deposited directly as the desired composition, or may be formed by post diffusion reaction between different layers of successively deposited components or/and between one or several components of the core alloy with one or several components deposited on the core alloy surfaces. For example, copper can be deposited onto a nickel based alloy. During the oxidation step, nickel diffuses into the copper envelope which is oxidized to a mixed nickel/copper oxide.

After the shaping step, the composite structures are submitted to a controlled oxidation in order to transform the alloy of the envelope into a ceramic envelope. The oxidation step is carried out at a temperature lower than the melting point of the alloys. The oxidation temperature may be chosen such that the oxidation rate is about 0.005 to 0.010 mm per hour. The oxidation may be conducted in air or in controlled oxygen atmosphere, preferably at about 1000°C. for 10–24 hours to fully oxidize the copper.

For some substrate alloys, it has been observed that a substrate component, in particular iron, or generally any component metal present in the substrate alloy but not present in the coating alloy, may diffuse into the ceramic oxide coating during the oxidation phase before oxidation is complete, or diffusion may be induced by heating in an inert atmosphere prior to oxidation. Diffusion of a coating component into the substrate can also take place.

Preferably, after the oxidation step, the composite is heated in air at about 1000°C. for about 100 to 200 hours. This annealing or ageing step improves the uniformity of the composition and the structure of the formed ceramic phase.

The ceramic phase is a solid solution of $(M_xCu_{1-x})O_y$, M being at least components of the envelope alloy. Because of the presence of the copper oxide matrix which plays the role of oxygen transfer agent and binder during the oxidation step, the envelope alloy can be transformed totally into a coherent ceramic phase. The stresses which usually occur due to the volume increase during the transformation of the envelope alloy are absorbed by the plasticity of the copper oxide phase which reduces the risks of cracking of the ceramic layer. When the envelope alloy is completely transformed into a ceramic phase, the surface of the refractory alloy of the core of the structure reacts with oxygen, and forms a $Cr_2O_3$-based oxide layer which plays the role of oxygen barrier impeding further oxidation of the core. Because of the similar chemical stabilities of the constituents of the ceramic phase formed from the copper based alloy and the chromium oxide phase of the core, there is no incompatibility between the ceramic envelope and the metallic core, even at high temperatures. The limited interdiffusion between the chromium oxide based layer at the metallic core surface, and the copper oxide based ceramic envelope may confer to the latter a good adherence on the metallic core.

The presence of CuO confers to the ceramic envelope layer the characteristics of a semi-conductor. electrical resistivity of CuO is about $10^{-2}$ to $10^{-1}$ ohm.cm at 1000°C., and this is reduced by a factor of about 100 by the presence of a second metal oxide such as NiO or $MnO_2$. The electrical conductivity of this ceramic phase may be further improved by incorporating a soluble noble metal into the copper alloy before the oxidation step. The soluble noble metals may be for example platinum, palladium or gold in an amount of up to 20–30% by weight. In such a case, a cermet envelope may be obtained, with a noble metal network uniformly distributed in the ceramic matrix. Another way to improve the electrical conductivity of the ceramic envelope may be the introduction of a dopant of the second metal oxide phase; for example, the NiO of the ceramic phase prepared from Ni-Cu alloys may be doped by lithium.

By formation of a solid solution with stable oxides such as NiO or $MnO_2$, the copper oxide based ceramic envelope has a good stability under corrosive conditions at high temperatures. Furthermore, after the ageing step, the composition of the ceramic phase may be more uniform, with large grain sizes, whereby the risk of grain boundary corrosion is strongly decreased.

The composite materials according to this invention can be used as: an anode for electrochemical processes conducted in molten salts, at temperatures in the range between 400–1000°C.; an anode substrate for similar processes, for example a substrate for anode coatings based on cerium oxyfluoride used in aluminum electrowinning; and as a construction material having a thermal barrier coating for high temperature applications.

The application of the composite materials as a substrate for cerium oxyfluoride coatings is particularly advantageous because the cerium oxyfluoride coating can interpenetrate with the copper-oxide based ceramic coating providing excellent adhesion. In addition, formation of the cerium oxyfluoride coating on the material according to the invention in situ from molten cryolite containing cerium species takes place with no or minimal corrosion of the substrate, and a high quality adherent deposit is obtained.

For this application as, anode substrate, it is understood that the metal being electrowon will necessarily be more noble than the cerium ($Ce^{3+}$) dissolved in the melt, so that the desired metal deposits at the cathode with no substantial cathodic deposition of cerium. Such metals can preferably be chosen from group IIIa (aluminum, gallium, indium, thallium), group IVA (titanium, zirconium, hafnium), group VA (vanadium, niobium, tantalum) and group VIIb (manganese, rhenium).

Advantages of the invention over the prior art will now be demonstrated by the following examples.

EXAMPLE 1

Oxidation of a copper - based alloy

A tube of Monel 400 ™ alloy (63% Ni - 2% Fe - 2.5% Mn - balance cu) of 10 mm diameter, 50 mm length, with a wall thickness of 1 mm, is introduced into a furnace heated at 1000°C., in air. After 400 hours of oxidation, the tube is totally transformed into a ceramic structure of about 12 mm diameter and 52 mm length, with a wall thickness of 1.25 mm. Under optical microscope, the resulting ceramic presents a monophase structure, with large grain sizes of about 200–500 micrometers. copper and nickel mappings, made by Scanning Electron Microscopy, show a very uniform distribution of these two components; no segregation of composition at the grain boundaries is observed. Electrical conductivity measurements of a sample of the resulting ceramic show the following results:

| TEMPERATURE (°C.) | RESISTIVITY (Ohm.cm) |
|---|---|
| 400 | 8.30 |
| 700 | 3.10 |
| 850 | 0.42 |
| 925 | 0.12 |
| 1000 | 0.08 |

EXAMPLE 2

Annealing of an oxidized copper - based alloy

Two tubes of Monel 400 ™ oxidized at 1000°C. in air as described in Example 1 are subjected to further annealing in air at 1000°C. After 65 hours, one tube is removed from the furnace, cooled to room temperature, and the cross section is examined by optical microscope. The total thickness of the tube wall is already oxidized, and transformed into a monophase ceramic structure, but the grain joints are rather loose, and a copper rich phase is observed at the grain boundaries. After 250 hours, the second tube sample is removed from the furnace and cooled to room temperature. The cross section is observed by an optical microscope. Increasing the ageing step from 65 hours to 250 hours produces an improved, denser structure of the ceramic phase. No visible grain boundary composition zone is observed.

Examples 1 and 2 thus show that these copper-based alloys, when oxidized and annealed, display interesting characteristics. However, as will be demonstrated by testing (Example 5) these alloys alone are inadequate for use as an electrode substrate in aluminum production.

EXAMPLES 3*a*, 3*b* and 3*c*

Production of composites according to the invention

EXAMPLE 3*a*

A tube with a semi-spherical end, of 10 mm outer diameter and 50 mm of length, is machined from a bar of Monel 400 ™. The tube wall thickness is 1 mm. A bar of Inconel ™ (type 600: 76% Ni - 15.5% Cr - 8% Fe) of 8 mm diameter and 500 mm length is inserted mechanically in the Monel tube. The exposed part of the Inconel bar above the Monel envelope is protected by an alumina sleeve. The structure is placed in a furnace and heated, in air, from room temperature to 1000°C. during 5 hours. The furnace temperature is kept constant at 1000°C. during 250 hours; then the furnace is cooled to room temperature at a rate of about 50°C. per hour. Optical microscope examination of the cross section of the final structure shows a good interface between the Inconel core and the formed ceramic envelope. Some microcracks are observed at the interface zone of the ceramic phase, but no cracks are formed in the outer zones. The Inconel core surfaces are partially oxidized to a depth of about 60 to 75 micron. The chromium oxide based layer formed at the Inconel surface layer interpenetrates the oxidized Monel ceramic phase and insures a good adherence between the metallic core and the ceramic envelope.

EXAMPLE 3*b*

A cylindrical structure with a semi-spheric end, of 32 mm diameter and 1OO mm length, is machined from a rod of Inconel-600 ™ (Typical composition: 76% Ni - 15.5% Cr - 8% Fe +minor components (maximum %): carbon (0.15%), Manganese (1%), Sulfur (0.015%), Silicon (0.5%), copper (0.5%)). The surface of the Inconel structure is then sand blasted and cleaned successively in a hot alkali solution and in acetone in order to remove traces of oxides and greases. After the cleaning step, the structure is coated successively with a layer of 80 micrometers of nickel and 20 micrometers of copper, by electrodeposition from nickel sulfamate and copper sulfate baths respectively. The coated structure is heated in an inert atmosphere (argon containing 7% hydrogen) at 500°C. for 10 hours, then the temperature is increased successively to 1000°C. for 24 hours and 1100°C. for 48 hours. The heating rate is controlled at 300°C./hour. After the thermal diffusion step, the structure is allowed to cool to room temperature. The interdiffusion between the nickel and copper layers is complete, and the Inconel structure is covered by an envelope coating of Ni-Cu alloy of about 100 micrometers. Analysis of the resulting envelope coating gave the following values for the principal components:

| | Coating Surface | Coating-Substrate interdiffusion zone |
|---|---|---|
| Ni (w %) | 71.8 | 82.8–81.2 |
| Cu (w %) | 26.5 | 11.5–0.7 |
| Cr (w %) | 1.0 | 3.6–12.0 |
| Fe (w %) | 0.7 | 2.1–6.1 |

After the diffusion step, the coated Inconel structure is oxidized in air at 1000°C. during 24 hours. The heating and cooling rates of the oxidation step are respectively 300°C./hour and 100°C./hour. After the oxidation step, the Ni-Cu envelope coating is transformed into a black, uniform ceramic coating with an excellent adherence on the Inconel core. Examination of a cross-section of the final structure shows a monophase nickel/copper oxide outer coating of about 120 micrometers and an inner layer of $Cr_2O_3$ of 5 to 10 micrometers. The inside of the Inconel core remained in the initial metallic state without any trace of internal oxidation.

EXAMPLE 3c

A cylindrical structure with a semi-spherical end, of 16 mm diameter and 50 mm length, is machined from a rod of ferritic stainless steel (Typical composition: 17% Cr, 0.05% C., 82.5% Fe). The structure is successively coated with 160 micrometers Ni and 40 micrometers Cu as described in Example 3*b*, followed by a diffusion step in an Argon-7% Hydrogen atmosphere at 500°C. for 10 hours, at 1000°C. for 24 hours and 1100°C. for 24 hours. Analysis of the resulting envelope coating gave the following values for the principal components:

| | Coating surface | Coating-Substrate interdiffusion zone |
|---|---|---|
| Ni (w %) | 61.0 | 39.4–2.1 |
| Cu (w %) | 29.8 | 0.2–0 |
| Cr (w %) | 1.7 | 9.2–16.0 |
| Fe (w %) | 7.5 | 51.2–81.9 |

After the diffusion step, the ferritic stainless steel structure and the final coating is oxidized in air, at 1000°C. during 24 hours as described in Example 3*b*. After the oxidation step, the envelope coating is transformed into a black, uniform ceramic coating. A cross section of the final structure shows a multi-layer ceramic coatings composed of:

an uniform nickel/copper oxide outer coating of about 150 micrometers, which contains small precipitates of nickel/iron oxide;

an intermediate nickel/iron oxide coating of about 50 micrometer, which is identified as a $NiFe_2O_4$ phase; and a composite metal-oxide layer of 25 to 50 micrometers followed by a continuous $Cr_2O_3$ layer of 2 to 5 micrometers.

The inside of the ferritic stainless steel core remained in the initial metallic state. EXAMPLE 4

Testing of a composite according to the invention

A composite ceramic-metal structure prepared from a Monel 400-Inconel 600 structure, as described in Example 3*a*, is used as a anode in an aluminum electrowinning test, using an alumina crucible as the electrolysis cell and a titanium diboride disk as a cathode. The electrolyte is composed of a mixture of cryolite ($Na_3AlF_6$) with 10% $Al_2O_3$and 1% $CeF_3$ added. The operating temperature is maintained at 970–980°C., and a constant anodic current density of 0.4 A/cm$^2$ is applied. After 60 hours of electrolysis, the anode is removed from the cell for analysis. The immersed anode surface is uniformly covered by a blue coating of cerium oxyfluoride formed during the electrolysis. No apparent corrosion of the oxidized Monel ceramic envelope is observed, even at the melt line non-covered by the coating. The cross section of the anode shows successively the Inconel core, the ceramic envelope and a cerium oxyfluoride coating layer about 15 mm thick. Because of interpenetration at the interfaces of the metal/ceramic and ceramic/coating, the adherence between the layers is excellent. The chemical and electrochemical stability of the anode is proven by the low levels of nickel and copper contaminations in the aluminum formed at the cathode, which are respectively 200 and 1000 ppm. These values are considerably lower than those obtained in comparable testing with a ceramic substrate, as demonstrated by comparative Example 5.

EXAMPLE 5

Comparative testing of oxidized/annealed copper based alloy

The ceramic tube formed by the oxidation/annealing of Monel 400™ in Example 2 is afterwards used as an anode in an aluminum electrowinning test following the same procedure as in Example 4. After 24 hours of electrolysis, the anode is removed from the cell for analysis. A blue coating of oxyfluoride is partially formed on the ceramic tube, occupying about 1 cm of the immediate length below the melt line. No coating, but a corrosion of the ceramic substrate, is observed at the lower parts of the anode. The contamination of the aluminum formed at the cathode was not measured; however, it is estimated that this contamination is about 10–50 times the value reported in Example 4. This poor result is explained by the low electrical conductivity of the ceramic tube. In the absence of the metallic core, only a limited part of the tube below the melt line is polarized with formation of the coating. The lower immersed parts of the anode, non polarized, are exposed to chemical attack by cryolite. The tested material alone is thus not adequate as an anode substrate for a cerium oxyfluoride based coating. It is, hence, established that the composite material according to the invention (i.e. the material of Example 3*a* as tested in Example 4) is technically greatly superior to the simple oxidized/annealed copper oxide based alloy.

EXAMPLE 6

Testing of a composite material according to the invention

Two cylindrical structures of Inconel-600 ™ are machined as described in Example 3*b* and coated with a nickel-copper alloy layer of 250–300 micrometers by flame spraying a 70w% Ni - 30w% cu alloy powder. After the coating step, the structures are connected in parallel to two ferritic steel conductor bars of an anode support system. The conductor bars are protected by alumina sleeves. The coated Inconel anodes are then oxidized at 1000°C. in air. After 24 hours of oxidation, the anodes are transfered immediately to an aluminum electrowinning cell made of a graphite crucible. The crucible has vertical walls masked by an alumina ring, and the bottom is polarized cathodically. The electrolyte is composed of a mixture of cryolite ($Na_3AlF_6$) with 8.3% $AlF_3$, 8.0% $Al_2O_3$ and 1.4% $CeO_2$ added. The operating temperature is maintained at 970–980°C. The total immersion height of the two nickel/copper oxide coated Inconel electrodes is 45 mm from the semi-spherical bottom. The electrodes are then polarized anodically with a total current of 22.5A during 8 hours. Afterwards, the total current is progressively increased up to 35A and maintained constant for 100 hours. During this second period of electrolysis, the cell voltage is in the range 3.95 to 4.00 volts. After 100 hours of operation at 35A, the two anodes are removed, from the cell for examination. The immersed anode surfaces are uniformly covered by a blue coating of cerium oxyfluoride formed during the first electrolysis period. The black ceramic nickel/copper oxide coating of the non-immersed parts of the anode is covered by a crust formed by condensation of cryolite vapors over the liquid level. Examination of cross-sections of the anodes show successively:

an outer cerium oxyfluoride coating of about 1.5 mm thickness;

an intermediate nickel/copper oxide coating of 300–400 micrometers; and an inner $Cr_2O_3$ layer of 5 to 10 micrometers.

No sign of oxidation or degradation of the Inconel core is observed, except for some microscopic holes resulting from the preferential diffusion of chromium to the Inconel surface, forming the oxygen barrier $Cr_2O_3$ (Kirkendall porosity).

I claim:

1. A ceramic/metal composite material comprising a metal substrate with a surface ceramic coating in which the surface ceramic coating comprises an oxidized alloy of 15% to 75% by weight copper, 25% to 85% by weight of one or both of nickel or manganese, 0% to 5% by weight of one or more of lithium, calcium, aluminum, magnesium or ion and 0% to 30% by weight of one or more of platinum, gold or palladium in which the copper is fully oxidized and at least part of the nickel, manganese, or both is oxidized in solid solution with the copper oxide, and in which the substrate comprises 10–30% by weight of chromium and 55–90% of one or more of nickel, cobalt or iron and up to 15% by weight of one or more of aluminum, hafnium, molybdenum, niobium, silicon, tantalum, titanium, tungsten, vanadium, yttrium and zirconium, the interface of the substrate with the surface ceramic coating having an oxygen-barrier layer comprising chromium oxide.

2. The material of claim 1, in which the surface coating comprises copper-nickel oxide in solid solution and the substrate is an alloy comprising nickel with chromium.

3. The material of claim 1, in which the surface coating comprises copper-manganese oxide in solid solution and the substrate is an alloy comprising nickel with chromium.

4. The material of claim 1 in which the surface ceramic coating contains non-oxidized precious metal.

5. An anode for electrowinning a metal from molten salts containing compounds of the metal to be won, comprising a metal substrate with a surface ceramic coating comprising an oxidized alloy of 15% to 75% by weight copper, 25% to 85% by weight of one or both of nickel or manganese, 0% to 5% by weight of one or more of lithium, calcium, aluminum, magnesium or ion and 0% to 30% by weight of one or more of gold, platinum or palladium, in which the copper is fully oxidized and at least part of the nickel, manganese, or both is oxidized in solid solution with the copper oxide, and in which the substrate comprises 10–30% by weight of chromium and 55–90% of one or more of nickel, cobalt or iron and up to 15% by weight of one or more of aluminum, titanium, molybdenum, silicon, tantalum, tungsten, vanadium, zirconium, yttrium, hafnium or niobium, the interface of the substrate with the surface ceramic coating having an oxygen-barrier layer comprising chromium oxide.

6. The anode of claim 5 in which the surface coating comprises copper-nickel oxide in solid solution and the substrate is an alloy of nickel with chromium.

7. The anode of claim 5 in which the surface coating comprises copper-manganese oxide in solid solution and the substrate is an alloy of nickel with chromium.

8. The anode of claim 5 in which the surface ceramic coating contains non-oxidized precious metal.

9. The anode of claim 5, in which the surface ceramic coating serves as a substrate for a coating of an operative anode surface material.

10. The anode of claim 9 in which the operative anode surface material comprises cerium oxyfluoride.

11. A method of electrowinning aluminum from molten baths which method comprises:

establishing a molten electrolyte comprising cryolite with dissolved alumina;

immersing the anode of claim 5 in said molten electrolyte; and impressing an electrolysis current on said electrolyte.

12. A method of making the material of claim 1 comprising:

applying a copper-based alloy to the substrate alloy, and oxidizing the material to:

(*a*) fully oxidize the copper to copper oxide;

(*a*) at least partially oxidize other metal in the surface coating to stabilize the copper oxide; and (*c*) surface oxidize the substrate to form an oxygen-barrier interface oxide layer inhibiting further oxidation of the substrate.

13. The method of claim 12, wherein at least one component of the substrate alloy is caused to diffuse into the surface oxide coating.

* * * * *